US006443545B1

(12) United States Patent
Woerner

(10) Patent No.: US 6,443,545 B1
(45) Date of Patent: Sep. 3, 2002

(54) DRAWER CONSTRUCTION

(75) Inventor: Axel G. Woerner, Jamestown, NC (US)

(73) Assignee: Hafele America Co., Archdale, NC (US)

( * ) Notice: Subject to any disclaimer, the term of this patent is extended or adjusted under 35 U.S.C. 154(b) by 0 days.

(21) Appl. No.: 09/580,761

(22) Filed: May 30, 2000

(51) Int. Cl.[7] ..... A47B 88/00
(52) U.S. Cl. ..... 312/348.1; 312/263
(58) Field of Search ..... 312/330.1, 334.1, 312/348.1, 348.2, 257.1, 263, 260

(56) References Cited

U.S. PATENT DOCUMENTS 298,821 A * 5/1884 Brolaski ..... 312/348.1 X
1,352,002 A * 9/1920 Jones ..... 312/348.2 X
1,936,733 A 11/1933 Richardson
2,102,437 A * 12/1937 Richardson et al. . 312/348.1 X
2,185,770 A 1/1940 Larson
2,562,290 A 7/1951 Backus
2,701,174 A 2/1955 Franks
3,846,003 A 11/1974 Rockwell
3,876,270 A 4/1975 White
4,120,551 A 10/1978 Godtschalck
4,173,379 A 11/1979 van der Heiden et al.
4,277,122 A 7/1981 Bargiel
4,279,455 A 7/1981 Santo
4,379,604 A 4/1983 Rock et al.
4,466,675 A 8/1984 Ferdinand et al.
4,712,942 A 12/1987 Brown
4,802,716 A 2/1989 Rock et al.
4,842,351 A 6/1989 Rock et al.
4,846,078 A * 7/1989 Janson ..... 312/257.1 X
4,875,747 A 10/1989 Hollenstein
4,880,284 A 11/1989 Dickson et al.
4,909,581 A 3/1990 Haheeb
4,953,991 A 9/1990 Rock
5,090,786 A 2/1992 Albiez et al.
5,172,971 A 12/1992 Albiez
5,439,285 A 8/1995 Lautenschlager
5,462,349 A 10/1995 Grabher
5,466,058 A * 11/1995 Chan ..... 312/263 X
5,538,339 A 7/1996 Rock et al.
5,556,183 A 9/1996 Brustle et al.
5,597,221 A 1/1997 Grieser et al.
5,618,091 A 4/1997 Huber et al.
5,671,989 A 9/1997 Lautenschlager
5,743,608 A 4/1998 Johannes
5,823,650 A 10/1998 Lin

* cited by examiner

*Primary Examiner*—John G. Weiss
*Assistant Examiner*—Michael J. Fisher
(74) *Attorney, Agent, or Firm*—Womble Carlyle Sandridge & Rice, PLLC

(57) ABSTRACT

A drawer construction that may be quickly assembled without tools or separate hardware, including opposed side walls having a drawer bottom support and retainers for receiving and holding down opposed front and rear walls, and a drawer bottom.

14 Claims, 4 Drawing Sheets

DRAWER CONSTRUCTION

FIELD OF THE INVENTION

The present invention relates generally to furniture drawer assemblies, and particularly, to a drawer that may be quickly assembled without tools, separate hardware, or glues.

BACKGROUND OF THE INVENTION

For many years, furniture drawers, such as those for desks or cabinets, have been assembled in furniture manufacturers' plants from cut pieces of wood according to factory design specifications. Drawer assembly has been completed by either skilled artisans or through the use of special equipment designed specifically for the task. This, however, requires considerable warehouse storage space and shipping space for completed units, involves special handling requirements to minimize the risk of damage to assembled products, and ultimately results in higher per unit costs. Damage still often results, at considerable cost, in transporting the finished product from manufacturer to retailer and from retailer to the final customer.

One solution to these problems has been the development of furniture and drawer kits that include wooden pieces either cut to order or in commercially popular sizes precut and available off the shelf. Such kits require less storage space and are easier to ship, but often include complex assembly instructions, requiring a variety of tools and more than a modest level of skill for proper assembly. As a result, a variety of kits have been developed for home assembly or assembly at the retailer by less skilled do-it-yourselfers following very specific instructions and using special hardware developed specifically for use with the kit.

There is known in the art a drawer that is assembled from two side wall sections, two end wall sections, and a bottom, using separate metal tie members at each corner to hold the drawer together. The art also discloses a drawer slide which forms a side wall of a drawer and has holding devices for securing a rear wall. There is also known an interlocking drawer assembly suited for forming drawers from plastic in which male and female interlocking portions are formed in each individual panel, the panels being held together by hooks and positive detents. The prior art also discloses drawer assembly kits that include side, bottom, front, and rear plates and intricate arrangements of slots, protrusions, hooks, clips, and positioning lugs to effect a complete assembly. In assembling such kits, however, tools, as well as dexterity on the part of the assembler, are often required.

SUMMARY OF THE INVENTION

The present invention is directed to a five-piece drawer that may be quickly assembled without the use of tools, additional hardware, or glue, yet is strong and has sufficient durability to withstand many years of use. Further, such a drawer may be easily assembled by unskilled purchasers following simple instructions.

Accordingly, one aspect of the present invention is to provide a five-piece quickly assembled drawer that includes opposed side walls, a drawer bottom, and front and rear walls. Desirably, the walls and drawer bottom are constructed of a pressed wood, but any other suitable solid wood or wood composite material, as well as rigid plastic materials may be used. Each side wall is constructed of metal or a strong polymer and has a front and rear end, as well as a bottom ledge. The bottom ledge extends inwardly from the bottom edge and provides support for the drawer bottom when assembled. Retaining members are integrally provided and extend inwardly from the front and rear ends of the side walls for receiving and holding the drawer front and rear walls in place. Further, the retaining members extend downward at least as far as the bottom ledge to prevent the drawer bottom from sliding forward or rearward following assembly. For ease of assembly, to eliminate additional hardware, and to provide a snug fit, the retaining members may each include an angled flange extending from the free end of each retaining member. Each flange engages correspondingly angled slots in the front and rear walls. The angle between the retaining member and the flange should be less than about 90 degrees, and desirably between about 40 and 70 degrees to ensure proper containment and a snug fit. A roller and drawer slide may be integrally formed with each side wall, thus eliminating the need for attaching separate mounting hardware on the drawer assembly. Another aspect of the present invention is to provide downwardly extending cleats on the outer edges of the flanges for gripping and holding down the front and rear walls. These cleats further prevent the front and rear walls from being easily removed.

A horizontal groove may be formed across the outer surfaces of the front and rear walls parallel to the bottom edges thereof. One or more L-shaped connectors may be inserted in each groove for securement of the drawer bottom to the front and rear walls. A generally L-shaped clip having a flange for engaging the groove is a suitable connector; however, any other suitable connectors such as clips, hooks, springs, or the like, may be used. While these grooves and connectors are not required for satisfactory assembly of the drawer, they provide an additional measure of holddown force and prevent sagging of the drawer bottom in wide drawers.

These and other aspects of the present invention will become apparent to those skilled in the art after reading the following description of the preferred embodiment when considered with the drawings.

DESCRIPTION OF THE PREFERRED EMBODIMENTS

Figure 1:
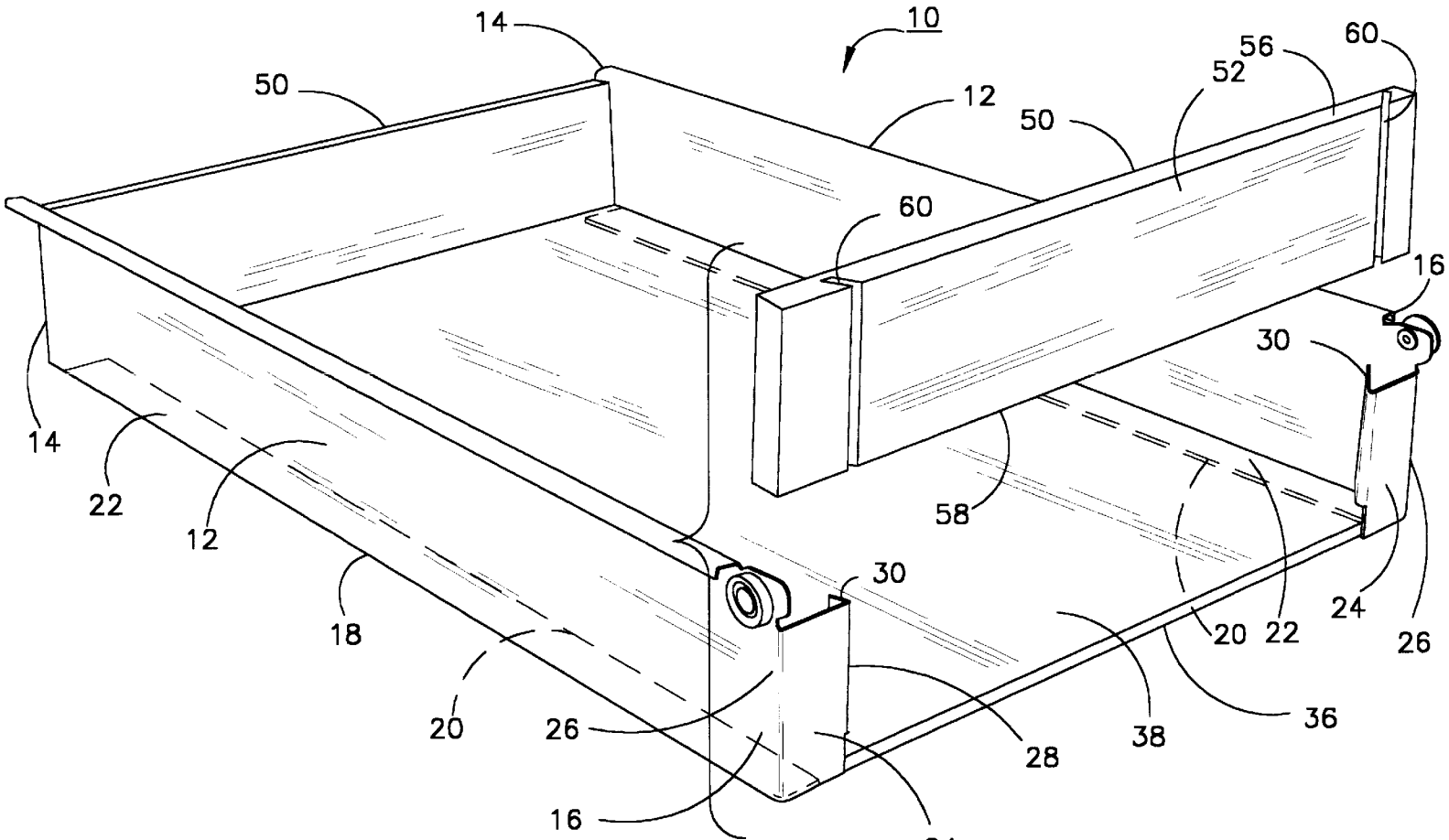
FIG. 1 is a rear perspective view of a drawer according to the present invention partially exploded to show a rear wall panel.
Figure 3:
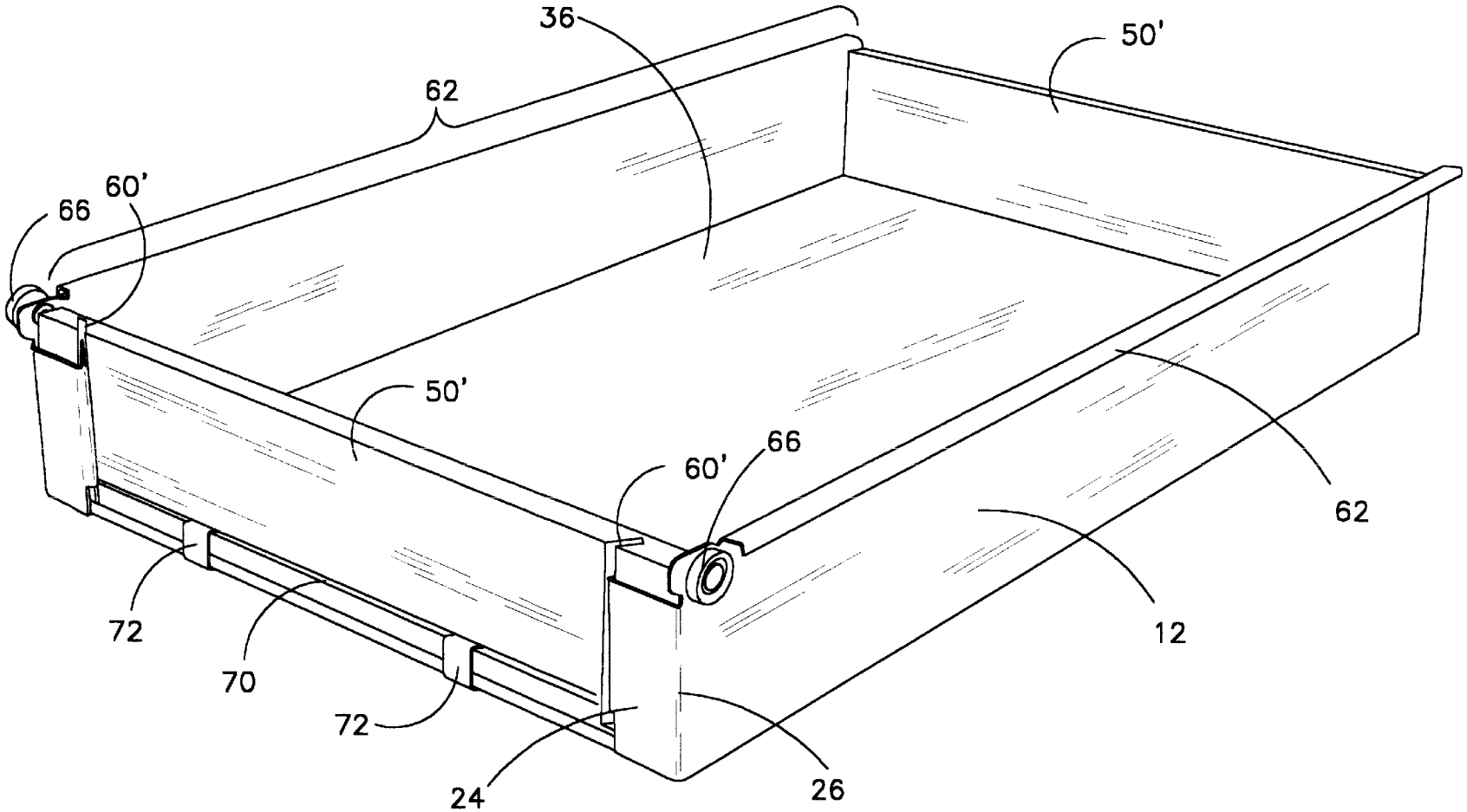
FIG. 3 is a top rear perspective view of the drawer of FIG. 2.

Referring now to the drawings in general and FIG. 1 in particular, it will be understood that the illustrations are for the purpose of describing a preferred embodiment of the invention and are not intended to limit the invention thereto. As best seen in FIGS. 1 and 3, a drawer construction that may be quickly assembled without tools, glues, or separate hardware, generally designated 10, includes opposed side walls 12, a drawer bottom 36, and opposed front and rear walls 50.

Figure 4:
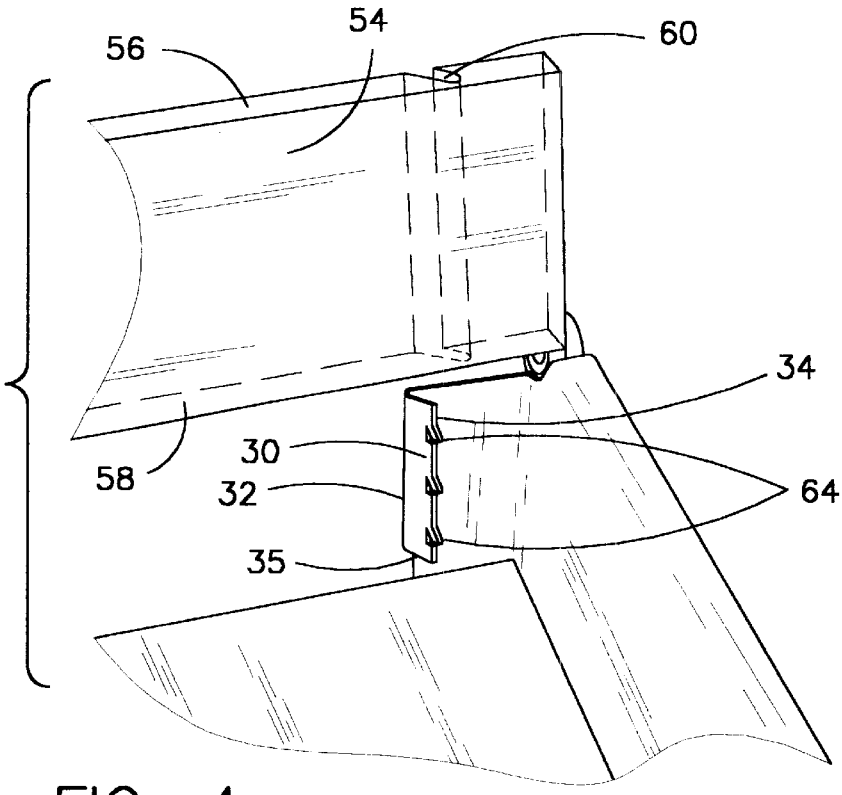
FIG. 4 is a perspective view of the retainer and flange formed with the side wall.
Figure 5:
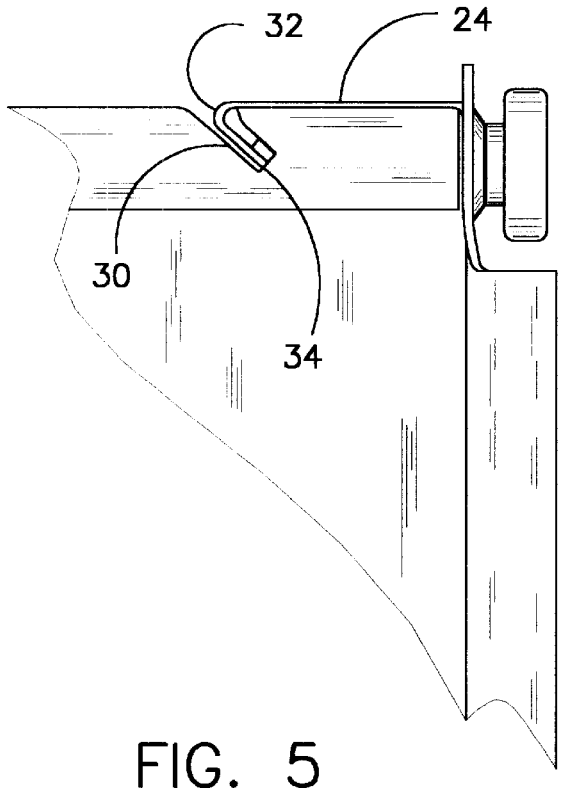
FIG. 5 is a top view of the rear end of a drawer according to the present invention showing flanges engaging the grooves in the rear wall.

Opposed side walls 12 each have a front end 16, rear end 14, and bottom edge 18. Side walls 12 are desirably metal, but may also be formed from a molded plastic. Each side wall 12 has an integrally formed drawer bottom support 20 perpendicular to side wall 12 and extending inwardly from bottom edge 18 to support a drawer bottom 36 on the support upper surface 22. Although shown in FIG. 2 as extending substantially the length of side walls 12, drawer support bottom 20 need not be continuous and may alternatively be formed as a plurality of spaced apart supports. A retainer 24 is integrally formed at each side wall front end 16 and rear end 14. Retainers 24 are attached to side walls 12 at the front and rear comers 26 and extend inwardly from and perpendicular to side walls 12, terminating at inner edges 28. Retainers 24 also extend downward at least as far as drawer bottom support 20 to prevent the drawer bottom 36 from sliding forward or rearward once assembled. As best seen in FIGS. 4 and 5, flanges 30 extend at an angle from inner edges 28 of retainers 24 to the free edges 34. Flanges 30 include a lower edge 35. The flanges 30 are angled and extend outwardly toward side walls 12. To ensure proper containment of front and rear walls 50, flanges 30 should be angled at less than about 90 degrees to retainers 24, and desirably between about 40 and 70 degrees. The orientation of flanges 30 with respect to retainers 24 provides a snug connection without the need for any other fasteners or glues. To eliminate the need for additional mounting hardware, each side wall 12 preferably has an integrally formed drawer slide rail 62 and roller 66. In this regard, the side wall 12 also serves as a drawer slide with a roller for mating with a drawer guide or rail mounted in a cabinet.

Figure 2:
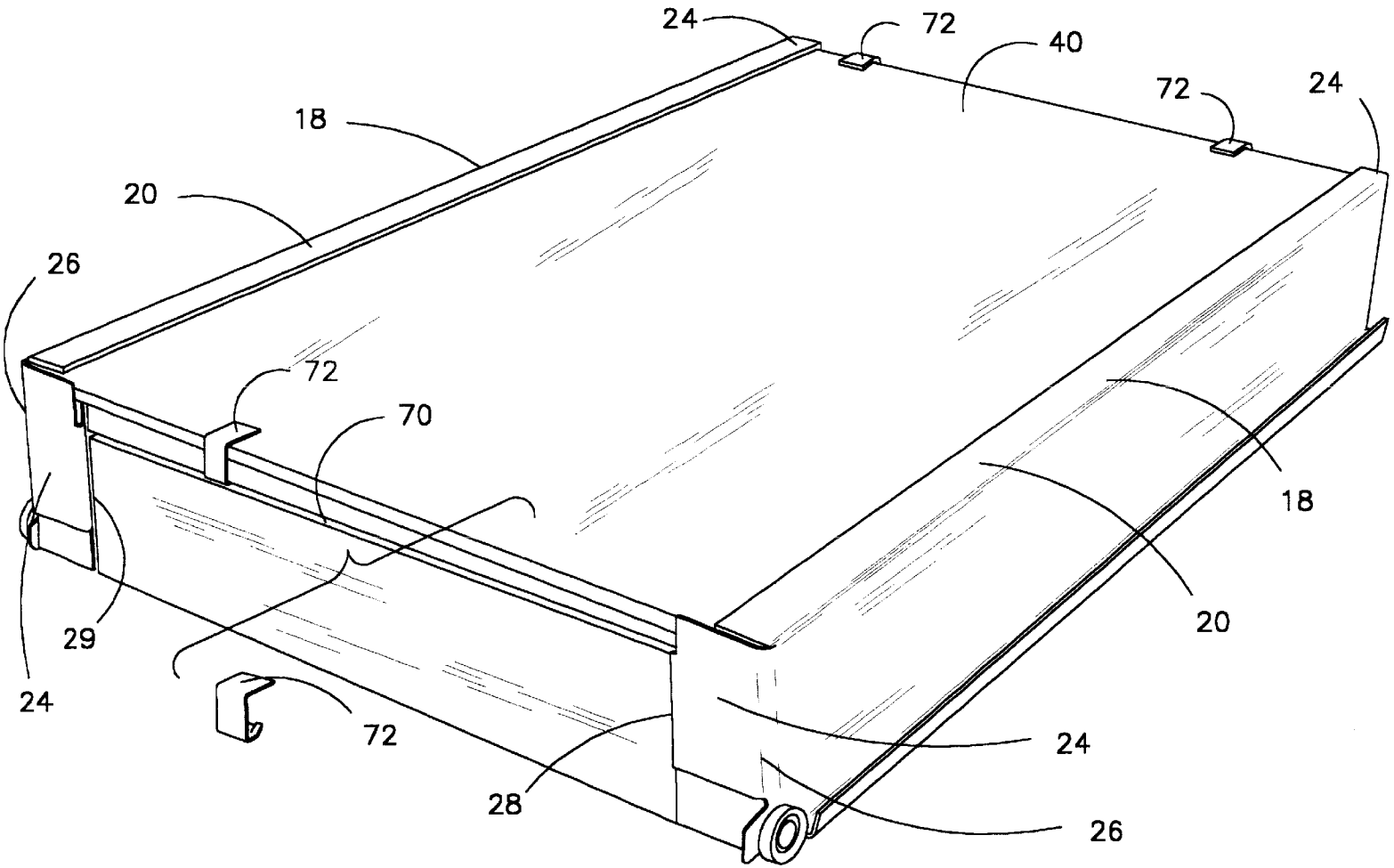
FIG. 2 is a bottom rear perspective view of an alternative embodiment of a drawer according to the present invention illustrating a groove and connectors for preventing drawer bottom sagging.

As shown in FIGS. 1 and 2, drawer bottom 36 has an inner surface 38 and outer surface 40, whereby outer surface 40 is adjacent to and supported by the upper surface 22 of drawer bottom support 20. Preferably, drawer bottom 36 is constructed of pressed wood, but wood or wood composites, plastic, metals or alloys, or other suitable materials may be used.

As best seen in FIGS. 1 and 4, front and rear walls 50 (FIG. 1) and 50'(FIG. 4) are identical and have inner surfaces 54 and outer surfaces 52 as well as top surfaces 56 and bottom surfaces 58. Front and rear walls 50, 50' are also preferably constructed of pressed wood, but solid wood or wood composites, molded plastics, or other suitable materials may be used. Slots 60, 60' are formed in each end of walls 50, 50' to correspond to the angle and shape of flanges 30. When front and rear walls 50, 50' are pushed down against inner surface 38, flanges 30 engage slots 60, 60' allowing walls 50, 50' to slide down against the drawer bottom 36. As best seen in FIG. 4, the lower edges 35 of flanges 30 are spaced from drawer bottom support 20 by a distance greater than the thickness of drawer bottom 36 such that drawer bottom 36 is permitted to rest on support 20 beneath end walls 50, 50' without interference with flanges 30. Desirably, a plurality of cleats 64 extend downwardly from the inner edges 34 of flanges 30 for gripping and holding down walls 50, 50' and for preventing walls 50, 50' from being easily withdrawn. Because cleats 64 are integrally formed on inner edges 34, no periodic adjustments or tightening are necessary. When assembled, the front and rear walls 50, 50' are thus securely held down and in place without any other fasteners or glue.

For wider drawers constructed according to the present invention, a groove 70 parallel to the bottom surfaces 58 of front and rear walls 50' may be formed in outer surfaces 52 for receiving connectors 72. At least one connector 72 is inserted in each groove 70 for joining the front and rear walls 50' to drawer bottom 36. As best seen in FIG. 2, an L-shaped clip with a flange for engaging groove 70 provides a suitable connector; however, other suitable connectors such as clips, hooks, springs, and the like, may be used. Once assembled, the drawer provides a durable construction suitable for many years of use, without the need for periodic adjustments customary with other drawer constructions.

Certain modifications and improvements will-occur-to those skilled in the art upon a reading of the foregoing description. It should be understood that all such modifications and improvements have been deleted herein for the sake of conciseness and readability, but are properly within the scope of the following claims.

I claim:

1. A drawer construction comprising:

(a) front and rear walls and a drawer bottom, said front and rear walls each having a spaced apart pair of substantially vertical grooves former therein;

(b) opposed side walls, each having an integrally formed drawer bottom support extending inwardly from a lower ledge, and integrally formed front and rear wall retainers extending inwardly from each end thereof;

(c) wherein said front and rear wall vertical grooves slidably receive said front and rear wall retainers to maintain said front and rear walls and drawer bottom in assembled relation.

2. The drawer construction of claim 1 further including a roller and drawer slide integrally attached to each said side wall.

3. The drawer construction of claim 1 wherein said front and rear wall retainers extend inwardly from and perpendicular to said side walls, terminating in inner edges.

4. The drawer construction of claim 3 further including flanges extending from the inner edges of said front and rear wall retainers angularly toward the side walls.

5. The drawer construction of claim 4 wherein said flanges are angled at less than about 90 degrees to said retainers.

6. The drawer construction of claim 5 wherein said flanges are spaced from the drawer bottom support by a distance greater than the thickness of the drawer bottom, permitting said drawer bottom to rest on said drawer bottom support without interference with said flanges.

7. The drawer construction of claim 4 further including a plurality of cleats integrally formed with and extending downwardly from said flanges.

8. A drawer that may be quickly assembled without tools or separate hardware comprising:

(a) opposed side walls, each said side wall having
  (i) a front end, a rear end, and a bottom edge;
  (ii) a drawer bottom support extending inwardly from the bottom edge of said side wall and having an upper surface for holding a drawer bottom;
  (iii) retainers at the front end and rear end of said side wall extending inwardly from and perpendicular to said side wall, terminating in inner edges; and
  (iv) flanges extending from the inner edges of said retainers angularly toward the side walls;

(b) a drawer bottom supported by the upper surface of said drawer bottom support; and (c) opposed front and rear walls, each having an inner and outer surface and a slot formed in the outer surface adjacent each end at an angle corresponding to and for receiving the flange of the adjacent retainer.

9. The drawer of claim 8 wherein said flanges are angled at less than about 90 degrees to said retainers.

10. The drawer of claim 8 wherein said flanges are spaced from the drawer bottom support by a distance greater than the thickness of the drawer bottom, permitting said drawer bottom to rest on said drawer bottom support without interference with said flanges.

11. The drawer of claim 8 further including a plurality of cleats integrally formed with and extending downwardly from said flanges.

12. The drawer of claim 8 wherein said front and rear walls rest on said drawer bottom when assembled.

13. The drawer of claim 8 further including a groove formed in the outer surfaces of said front and rear walls and parallel to said bottom surfaces of the front and rear walls, wherein connectors are inserted in said front and rear wall grooves for maintaining the engagement of the drawer bottom with the lower edges of the front and rear walls to prevent sagging.

14. The drawer of claim 8 further including a roller and drawer slide integrally formed with each said side wall.

* * * * *